US011191347B1

(12) United States Patent
Krivda

(10) Patent No.: US 11,191,347 B1
(45) Date of Patent: Dec. 7, 2021

(54) TOOL SYSTEM

(71) Applicant: Dexter Krivda, Corunna (CA)

(72) Inventor: Dexter Krivda, Corunna (CA)

( * ) Notice: Subject to any disclaimer, the term of this patent is extended or adjusted under 35 U.S.C. 154(b) by 0 days.

(21) Appl. No.: 16/561,233

(22) Filed: Sep. 5, 2019

(51) Int. Cl.

| | |
|---|---|
| ***A45F 5/02*** | (2006.01) |
| ***B25B 15/02*** | (2006.01) |
| ***B25B 23/16*** | (2006.01) |
| *A45F 5/00* | (2006.01) |

(52) U.S. Cl.
CPC ..... *A45F 5/021* (2013.01); *B25B 15/02* (2013.01); *B25B 23/16* (2013.01); *A45F 2005/006* (2013.01); *A45F 2200/0575* (2013.01)

(58) Field of Classification Search
CPC .... A45F 5/021; A45F 5/004; A45F 2005/006; A45F 2005/0575; A45F 2005/0566; B25B 23/0042
See application file for complete search history.

(56) References Cited

U.S. PATENT DOCUMENTS 2,718,249 A * 9/1955 Hill ..... B25B 23/16 81/460
4,474,303 A * 10/1984 Maccise ..... A45C 11/20 206/545
4,951,533 A * 8/1990 Hillinger ..... B25B 15/02 16/DIG. 12
5,339,487 A * 8/1994 Kasper ..... A47L 9/18 15/246.2
D362,180 S * 9/1995 Haines ..... D9/529
5,975,786 A * 11/1999 Chang ..... B66C 1/66 403/78
6,186,352 B1 * 2/2001 Hwang ..... A01K 5/0114 220/23.86
D469,233 S * 1/2003 Begnani ..... D32/53
6,776,317 B1 * 8/2004 Parker ..... A45F 5/00 224/250
6,813,976 B2 11/2004 Malvini et al.
2006/0272890 A1 * 12/2006 Harmon ..... A45F 5/00 182/3
2007/0125818 A1 * 6/2007 Forster ..... A63C 11/025 224/586
2008/0163464 A1 * 7/2008 Baumann ..... A45F 5/02 24/3.12
2012/0267403 A1 * 10/2012 Ward, Jr. ..... A45F 5/00 224/219

* cited by examiner

*Primary Examiner* — Scott T McNurlen
(74) *Attorney, Agent, or Firm* — Sanchelima & Associates, P.A.; Christian Sanchelima; Jesus Sanchelima

(57) ABSTRACT

A tool system including a handle assembly, a swiveling butt end assembly, a ring assembly, and a tether is disclosed. When using tools at elevated heights there is often accidents involved in which tools drop and possibly injure pedestrians down below. The tool system prevents such events from occurring. The handle assembly importantly includes a swiveling butt end assembly with a ring assembly attached. The ring assembly receives the tether which is attached to a user and to a tool. The tether keeps the tools within reach of the use if there is an accidental dropping. With the swiveling butt end assembly the tether does not tangle or break. The swiveling butt end assembly allows for the handle to freely rotate while tied to the tether. This prohibits tension on the tether to prevent damage to the tether. Also, eliminating the chance of dropping the tool from an elevated height.

16 Claims, 4 Drawing Sheets

TOOL SYSTEM

BACKGROUND OF THE INVENTION

1. Field of the Invention

The present invention relates to a tool system and, more particularly, to a tool system that is tethered and capable of assisting a user in preventing losing or misplacing of tools.

2. Description of the Related Art

Several designs for tethered tools have been designed in the past. None of them, however, include a screwdriver with a swiveling ring on the base of the handle for removably attaching a tether or lanyard to the tool. During construction, home improvement or any other situation under the realm of carpentry, tools and more specifically, hand tools are necessary to complete the tasks at hand. Often times it is required for such work to be done while a user is elevated from the ground at various heights all depending on the work being done and completed. There may be instances in which users may lose a grip on their hand tools such as screwdrivers at such heights. That proves to be an inconvenience for a variety of reasons. The tool may be lost forever if it happens to fall in a location that is inaccessible, the tool may get damaged, the tool may cause injury to a person that might be struck by such a falling tool, or the work may have to be halted if there is no replacement tools readily available. So, it goes to show that losing one's tools during work is a situation that can easily take an unpleasant turn. Time is most certainly lost if this inconvenience should occur. Hence, there is a need for a tethered tool that attaches to a user to prevent losing of the tools and time. Should the user lose grip on their tools, such as screwdrivers, the tether will maintain the tool within reach of the user. Additionally, the user is less likely to misplace their tools if they are attached to the user. The present invention may even prevent theft of tools to occur since it allows for the tools to always be within sight and monitored. Losing of a tool may even prove to be dangerous to the user. In the event that a user drops a tool and attempts to retrieve the tool as it is dropping, they may lose their footing and fall from dangerous heights.

Applicant believes that a related reference corresponds to U.S. Pat. No. 6,813,976 issued to Phillip Joseph Malvini et al. for a Tethered Hand Tool. It is a hand tool tethering system for use with hand tools that includes a retractor adapted to be included in the housing of the hand tool, a tether attached to the hand tool's retractor mechanism at one end, and to a coupling device at the opposite end for attachment to an operator or to a selected support structure. However, it differs from the present invention because the Malvini et al. reference involves tethering means that are within the housing of the tools. The present invention has means that permit for tether to be removably attached, thereby meaning that the hand tools are still comfortable to use without a tether attached. Importantly, the present invention includes a swiveling end that prevents the tether from tangling and also from breaking from tension.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a tethered tool system that prevents losing of tools such as hand tools.

It is another object of the present invention to provide a tethered tool system that is tangle free.

It is still yet another object of the present invention to provide a tethered tool system that increases the safety of users and others located below the user.

It is still another object of the present invention to provide a tether tool system that is durable.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
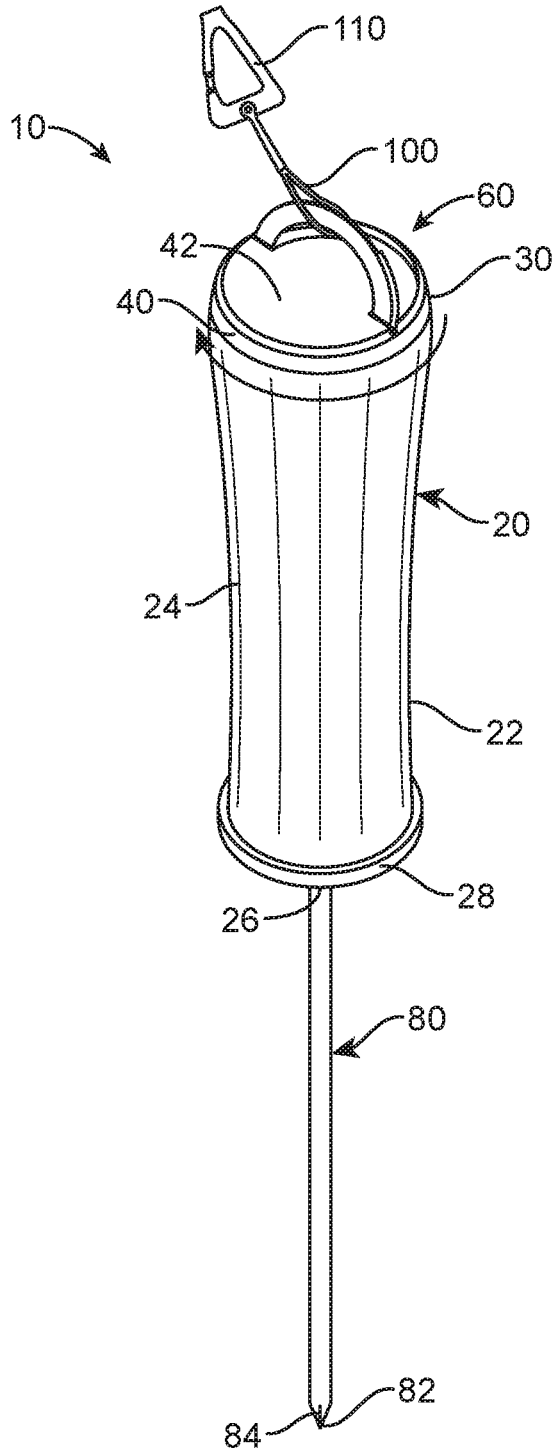
FIG. 1 represents an isometric view of the present invention.

Referring now to the drawings, where the present invention is generally referred to with numeral 10, it can be observed that, tethered tool system 10, basically includes a handle assembly 20, a swiveling butt end assembly 40, and a ring assembly 60.

When working at elevated heights there is risks involved. There are many things that could go wrong to cause unfortunate events. One such event is dropping of hand tools from such elevated heights due to a loss of grip or other events. The dropping of the hand tools can cause injury to a passerby down below. Typically, hand tools have sharp ends and injure a person especially if making contact with the person at an accelerated speed. The tool may also be lost forever if it happens to fall in a location that is inaccessible. Another possibly is that the tool may get damaged to the point that it is not usable or functional. Another situation that may arise is that work may have to be halted if there are no replacement tools readily available once the original hand tool has been dropped. Unfortunately, time is also lost when a hand tool is dropped from an elevated height. Hence, there is a need for a tethered tool system that attaches to a user to prevent losing of the tools and time. The tether tool system also prevents the aforementioned events and their undesirable outcomes. The present invention allows for the tool to be within reach of the user at all times.

Figure 2:
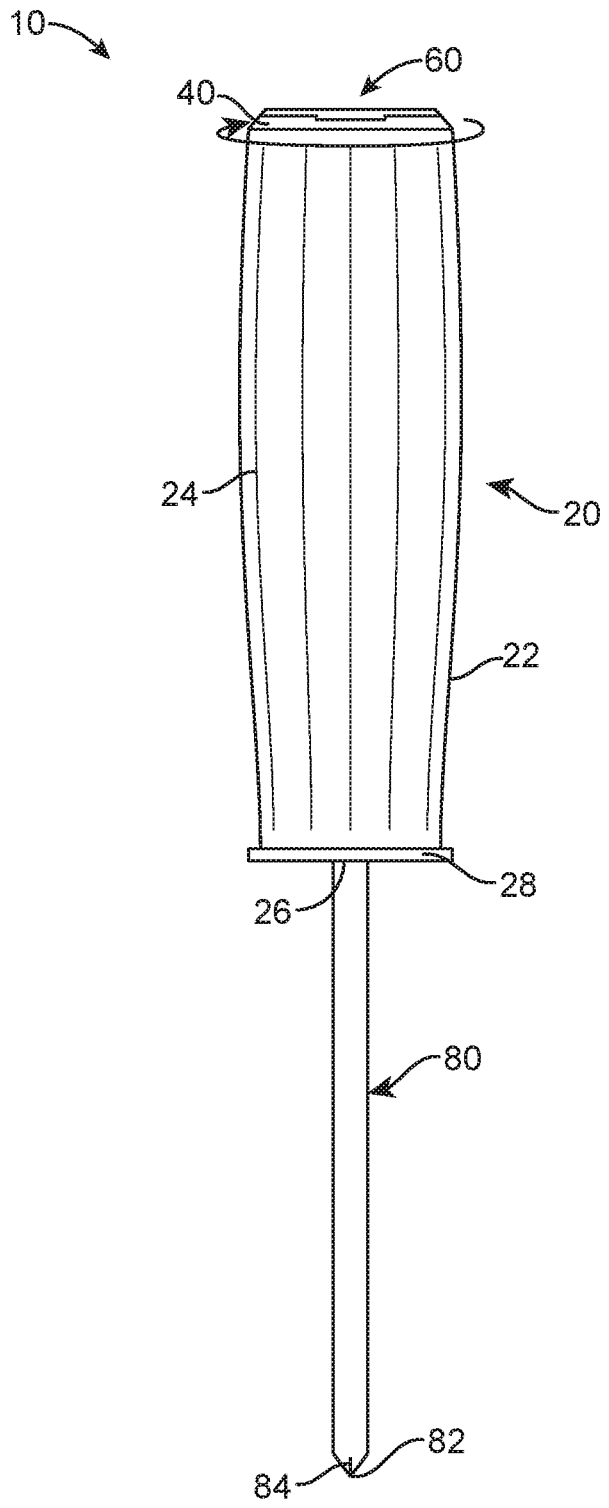
FIG. 2 represents a front view of the present invention.
Figure 3:
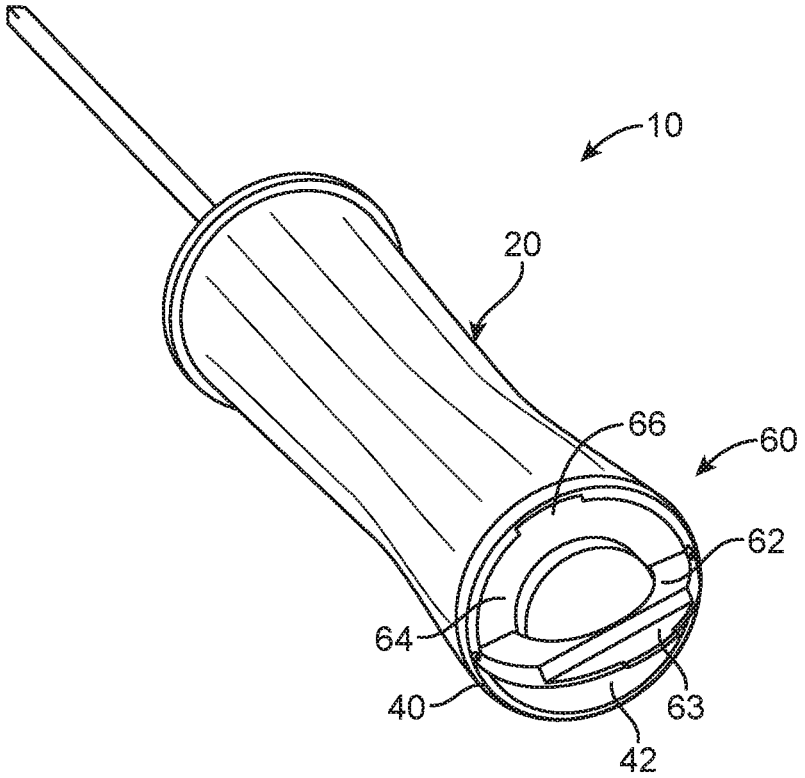
FIG. 3 shows a ring assembly in a closed position.
Figure 4:
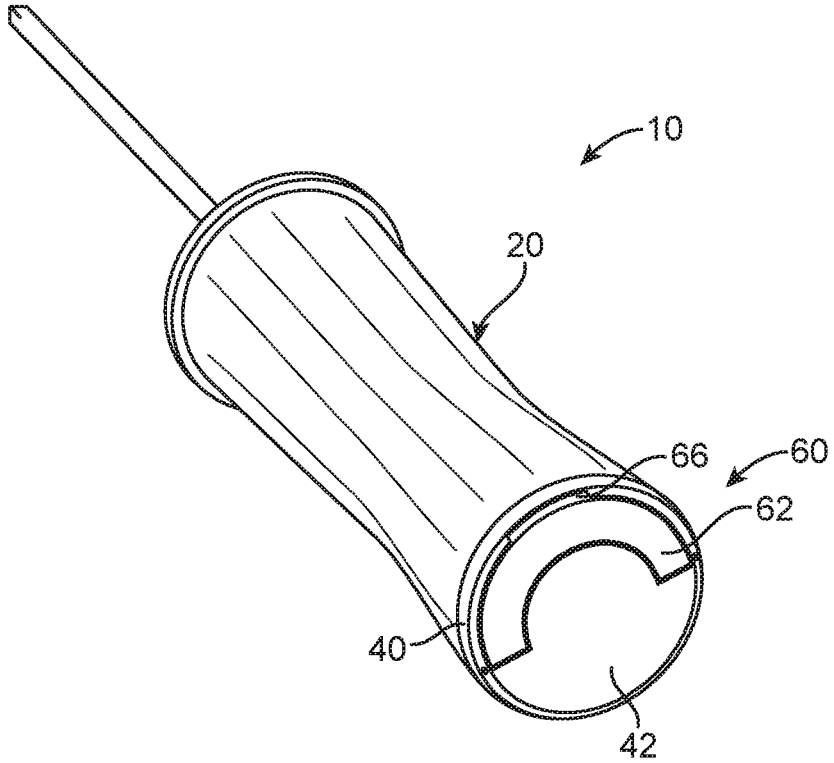
FIG. 4 shows a ring assembly in an opened position, that allows tethering of tools.
Figure 5:
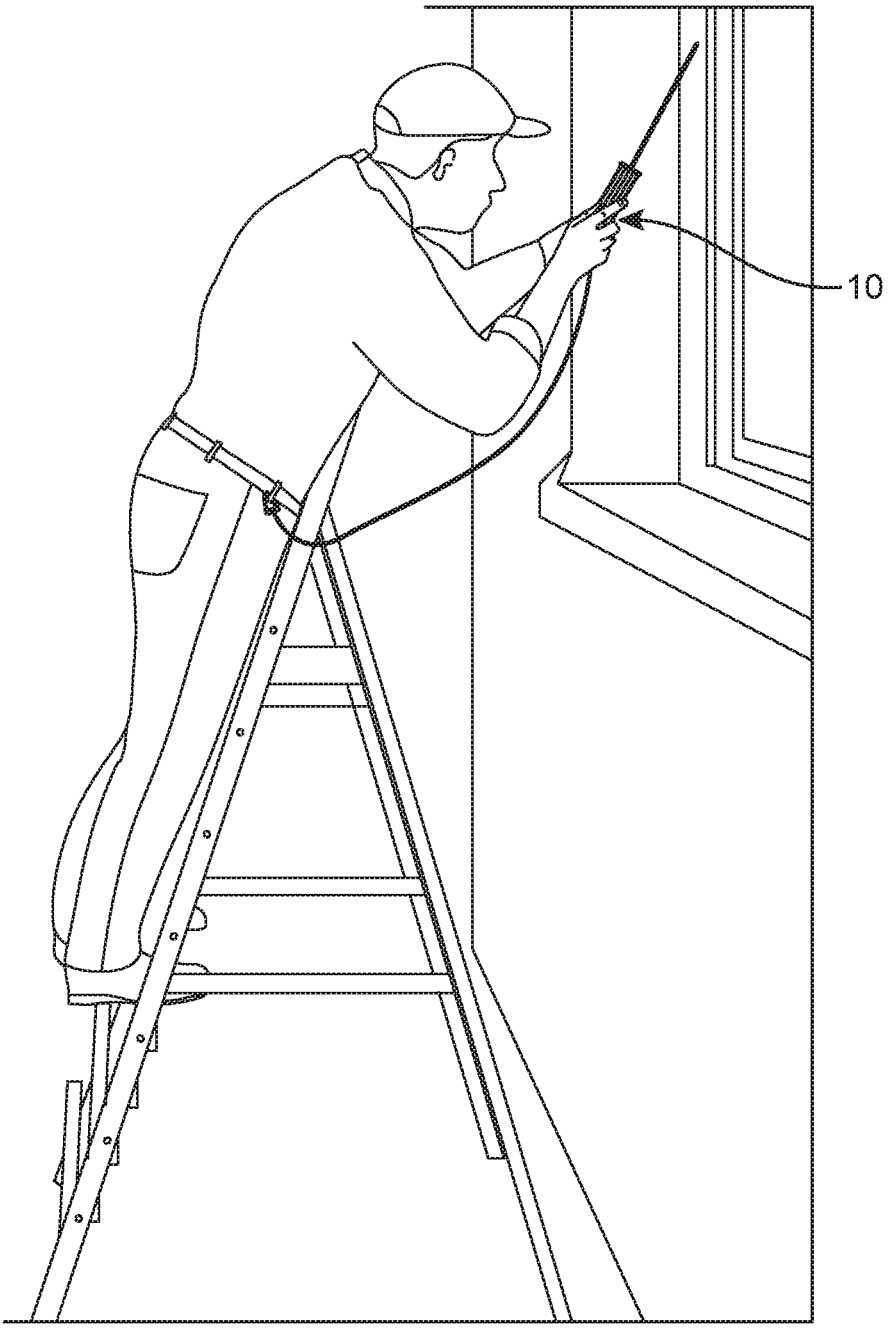
FIG. 5 is a representation of the present invention in an operational setting at a height from the ground.

Referring to FIG. 1 through FIG. 5, the present invention can be seen. It can be seen that tethered tool system 10 includes handle assembly 20. Handle assembly 20 is needed for a user to handle and operate the present invention. Handle assembly 20 includes a body 22. Body 22 is received by the hands of a user, preferably by one hand, as that is the way most hand tools such as screwdrivers are operated. Body 22 may optionally include a grip portion 24. Grip portion 24 may extend along the entire circumference of body 22. In an alternate embodiment grip portion 24 may only partially extend around the circumference of body 22. Grip portion 24 may extend either entirely or partially from a first body end 26 to a second body end 30 of body 22. Grip portion 24 may protrude from body 22. In an alternate embodiment grip portion 24 may be recessed in body 22. In another alternate embodiment grip portion 24 may be flush with body 22. Grip portion 24 may help a user maintain a better grasp on the tools they are working with, which may result in an easier time working. Better grip may be necessary due to sweaty palms that may occur when a user is under working conditions. Grip portion 24 may provide comfort to a user when they are handling and operating tether tool system 10. This allows for a user to comfortably use the present invention for the entire duration of their work no matter how long it takes. The provided grip portion 24 aid in improving the efficiency of a user as they require less breaks due to the comfort of grip portion 24. Grip portion 24 may be made of rubber or plastic, but any other materials may be suitable. That is materials that may provide comfort, a surface with friction or both. At first body end 26 of body 22 of handle assembly 20 may be a hand guard 28. Hand guard 28 makes it so that a user maintains their hands on grip portion 24 at least partially. This also increases the safety of a user as the user is forced to maintain a handle on the designated handling surface, grip portion 24, since hand guard 28 makes gripping tether tool system 10 below handle assembly 20 difficult. Additionally, a user maintains their hands on grip portion 24 of body 22 instinctively due to hand guard 28. At second body end 30 of body 22 may importantly be swiveling butt end assembly 40 rotatably mounted thereon.

Swiveling butt end assembly 40 may be mounted thereon second body end 30 through known means in the art of mounting. That is such as fasteners, screws or the like. Importantly, swiveling butt end assembly 40 may freely rotate 360 degrees with no restrictions. Handle assembly 20 and swiveling butt end assembly 40 do not rotate and spin at the same time. Rather only one of handle assembly 20 swiveling butt end assembly 40 spins and rotates. On a top surface 42 of swiveling butt end assembly 40 may be ring assembly 60 mounted thereon. This allows for a tether 100 to be attached to ring assembly 60 without the chance of creating tension or tangling of tether 100. Thereby preventing the chance of damage occurring to tether 100, which minimizes the chance that a user drops tether tool system 10. It is suitable for tether 100 to be a rope, string, lanyard or the like. In an alternate embodiment, tether 100 may be retractable. Tether 100 may extend when the present invention is in Tether 100 aids in attaching tether tool system 10 to a user. Tether 100 attaches to tethered tool system 100 on one end and to a user on another. If the user should lose a handle on tether tool system 10 tether 100 keeps the present invention within reach of the user. This allows the user to keep working without concern for loss of work tools or time to retrieve them. A user is also then able to be more efficient with their time. On the end of tether 100 that attaches to a user a carabiner 110 may be mounted thereon. Carabiner 110 may then be used to attach the present invention to the clothing of a user or a harness, for example. In an alternative embodiment, tether 100 may attach around the neck of a user instead with tethered tool system 10 also attached. In an alternative embodiment, hooks, loop and hook straps, or other means may be suitable to use in place carabiner 110. Since it is unlikely that tether tool system 10 is dropped the aforementioned events and their outcomes become unlikely to occur as well. Thereby resulting in increased safety of the user, passersby and tether tool system 10.

Ring assembly 60 can be found on top surface 42 of swiveling butt end assembly 40. Ring assembly 60 may further include a ring hook 62, a ring slot 64 and a ring opening cavity 66. Ring hook 62 may preferably be hingedly mounted to top surface 42 of swiveling butt end assembly 40. Ring assembly 60 may have a closed position and an opened position. In the closed position, ring hook 62 is to insert and store in ring slot 64. Ring hook 62 may be flush against top surface 62 of swiveling butt end assembly 40 when in ring slot 64. To achieve the opened positioned a user may use ring opening cavity 66 to extend ring hook 62 from ring slot 64. Ring opening cavity 66 may be an opening that in alternate embodiments may be sloped and inclined opening adjacent to ring slot 64. A user can then simply insert their fingernail into ring opening cavity 66 and pop out ring hook 62. Ring hook may include an opening portion 63 adapted to allow a user to grab ring hook 62 with their finger or finger nail to extend ring hook 62 from ring slot 64. In the opened position tether 100 may be attached to ring hook 62. It is possible to use the present invention without tether 100 attached and in such a case ring hook 62 may be stored in ring slot 64. Preferably, ring hook 62 may be semicircular shaped, but any other shaped adapted to receive tether 100 therethrough may be suitable. Ring slot 64 may also be any shape and size that cooperates with the shape and size of ring hook 62. In an alternate embodiment, ring slot 64 may extend to the very edge of top surface 42 to allow more space for larger attachment means.

It can be seen that the present invention also includes a screwdriver shaft 80. Screwdriver shaft 80 may be a thin rod that extends partially into body 22 of handle assembly 20. In an alternate embodiment, screwdriver shaft 80 may extend entirely through body 22 until second body end 30. Screwdriver shaft 80 includes a shaft distal end 82. At shaft distal end 82 is may be driver bit 84. Any driver bit shape, size or type may be suitable.

It should be understood that any shape or size or dimension may be suitable for any component or element of tether tool system 10. It should also be understood that materials are not limiting of the present invention. Any materials such as rubber, metal, plastic or the like may be suitable for any one component of tethered tool system 10. It should be understood that tether tool system 10 may meet the requirements and regulations set forth to work in environments elevated from the ground. Thereby meaning that the present invention may be preferable to use in industrial settings as the present invention complies with safety regulations and requirements.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A tool system, comprising:

a. a handle assembly having a body, said body including a first body end and a second body end;

b. a swiveling butt end assembly rotatably mounted atop of said body at said first body end in constant abutting contact therewith, said swiveling butt end assembly having a top surface;

c. a ring assembly having an opened position and a closed position, said ring assembly including a ring hook, a ring slot and a ring opening cavity, said ring hook being hingedly mounted to said top surface of said swiveling butt end assembly, wherein a portion of said swiveling butt end is covered by the ring hook when in the open position and the closed position, said ring hook being flush with said top surface when in said closed position, said ring slot being recessed within said swiveling butt end assembly at said top surface, said ring hook concealed within said ring slot when in the closed position, said ring opening cavity being located at a perimeter of said ring slot, said ring hook includes an opening portion attached thereto, said opening portion received within said ring opening cavity when said closed position is achieved, wherein the ring hook is partially within a peripheral lip of said swiveling butt end assembly in the closed position and said opening portion of the ring hook extends beyond said peripheral lip.

2. The system of claim 1, wherein said body of said handle assembly includes a grip portion.

3. The system of claim 2, wherein said grip portion extends about the entire circumference of said body.

4. The system of claim 2, wherein said grip portion partially extends about the circumference of said body.

5. The system of claim 2, wherein said grip portion is recessed in, protruding from or flush with said body of said handle assembly.

6. The system of claim 1, wherein said body of said handle assembly includes a hand guard at a handle proximal end.

7. The system of claim 1, wherein a tether is attached to said ring hook of said ring assembly on one end.

8. The system of claim 7, wherein said tether is a rope, string or lanyard.

9. The system of claim 7, wherein a carabiner is attached to said tether at a distal end.

10. The system of claim 1, wherein said ring hook and ring slot are semicircular shaped.

11. The system of claim 1, wherein a shaft extends entirely through said body of said handle assembly.

12. The system of claim 1, wherein a shaft extends partially through said body of said handle assembly.

13. The system of claim 1, wherein said opening portion is thinner than the ring hook.

14. The system of claim 1, wherein said swiveling butt end assembly is circular.

15. The system of claim 1, wherein said system further includes a screwdriver shaft, said screwdriver shaft extending from said second body end of said body, said screwdriver shaft having a shaft distal end having a driver bit mounted thereon.

16. A tool system, consisting of:

a. a handle assembly having a body, said body including a grip portion extending about the circumference of said body;

b. a swiveling butt end assembly rotatably mounted to a first body end of said body of said handle assembly, said swiveling butt end having a top surface, said swiveling butt end assembly being circular, said swiveling butt end assembly being exposed;

c. a ring assembly having an opened position and a closed position, said ring assembly including a ring hook hingedly mounted to said top surface, a ring slot and a ring opening cavity, said ring hook being mounted to said top surface of said swiveling butt end assembly, said ring hook being flush with said top surface when in said closed position, said ring slot extends along half the circumference of said top surface and said ring slot is recessed into said top surface, said ring slot is of a shape that mirrors said ring hook thereby allowing said ring hook to be nested in said ring slot in the closed position, said ring opening cavity extends from said ring slot towards a periphery of said top surface until contacting said periphery, said ring opening cavity is exposed in the opened position, said ring hook includes an opening portion attached thereto, said opening portion received within said ring opening cavity when said closed position is achieved, wherein the ring hook is partially within a peripheral lip of said swiveling butt end assembly in the closed position and said opening portion of the ring hook extends beyond said peripheral lip;

d. a tether being a rope, that is connected to said swiveling butt end assembly on one end and a clothing garment on a second end, securely engaging said tool system to a user, said tether is connected to said ring hook, as a user rotates said handle said swiveling butt end assembly also rotates preventing said tether from tangling; and e. a screwdriver shaft, said screwdriver shaft extending from a second body end.

* * * * *